US005997692A

United States Patent [19]

Taylor et al.

[11] Patent Number: 5,997,692

[45] Date of Patent: Dec. 7, 1999

[54] PROFILING WET END STARCH APPLICATOR

[75] Inventors: John A. Taylor, Baldwinsville; Marcus F. Foulger; Joseph E. Parisian, III, both of Watertown, all of N.Y.; Hanuman P. Didwania, Lisle; Clyde H. Sprague, W. Chicago, both of Ill.

[73] Assignees: GL&V-Paper Machine Group, Inc., Trois-Rivieres, Canada; Jefferson-Smurfit Corporation, Carol Stream, Ill.

[21] Appl. No.: 08/996,546

[22] Filed: Dec. 23, 1997

Related U.S. Application Data

[63] Continuation-in-part of application No. 08/597,828, Feb. 7, 1996, Pat. No. 5,792,317.

[51] Int. Cl.[6] ..... D21H 23/28

[52] U.S. Cl. ..... 162/175; 162/135; 162/184; 162/186; 162/252; 162/265; 162/266; 162/DIG. 11; 118/325; 118/602; 118/672; 118/689

[58] Field of Search ..... 425/378.1; 162/175, 162/135, 183, 184, 185, 186, 265, 266, 252, DIG. 11; 118/325, 672, 689, 602

[56] References Cited

U.S. PATENT DOCUMENTS

| | | | |
|---|---|---|---|
| 1,344,603 | 6/1920 | Warren | 162/266 |
| 1,909,150 | 5/1933 | Bell-Irving et al. . | |
| 2,318,469 | 5/1943 | Derby et al. | 425/378.1 |
| 2,325,574 | 7/1943 | Wunderer | 425/378.1 |
| 2,330,282 | 9/1943 | Hazeltine et al. | 425/378.1 |
| 2,373,914 | 4/1945 | Quinn | 162/186 |
| 2,426,043 | 8/1947 | Muggleton | 162/266 |
| 3,493,463 | 2/1970 | Baker | 162/109 |
| 3,767,346 | 10/1973 | Mihalik | 425/378.1 |
| 3,989,085 | 11/1976 | Crosby | 162/198 |
| 4,093,016 | 6/1978 | Coleman | 162/186 |
| 4,152,202 | 5/1979 | DeLigt | 162/198 |
| 4,165,211 | 8/1979 | Ebeling et al. | 118/DIG. 4 |
| 4,230,743 | 10/1980 | Nakamura et al. | 427/146 |
| 4,624,213 | 11/1986 | Long et al. | 118/300 |
| 4,866,984 | 9/1989 | Houghton | 73/159 |
| 4,936,141 | 6/1990 | Anderson, Jr. et al. | 73/159 |
| 4,940,512 | 7/1990 | Hendren et al. | 162/109 |
| 4,970,895 | 11/1990 | Houghton et al. | 73/159 |
| 4,974,533 | 12/1990 | Ishizuka et al. | 118/411 |
| 4,991,432 | 2/1991 | Houghton et al. | 73/159 |
| 5,044,305 | 9/1991 | Shibata et al. | 118/73 |
| 5,104,488 | 4/1992 | Chase | 162/198 |
| 5,149,341 | 9/1992 | Taylor et al. | 55/36 |

FOREIGN PATENT DOCUMENTS

| | | | |
|---|---|---|---|
| 704036 | 2/1965 | Canada | 9/43 |

*Primary Examiner*—Peter Chin
*Attorney, Agent, or Firm*—Biebel & French

[57] ABSTRACT

A system for applying a suspension of uncooked starch particles in water to a web on a forming wire includes a source of such suspension and a source of dilution water, an application die positioned transversely of the web with an internal manifold opening into a downwardly opening die slot through which material flows from the manifold as a falling curtain onto the web. The die has a plurality of transversely spaced inlets leading into the manifold to define transversely spaced application zones across the web. The suspended starch and water are applied from the manifolds through control valves into the inlets by means of which the consistency or concentration of the starch may be varied at positions representing the application zones across the web to provide a desired strength profile to the dried web. The method includes the steps of controlling the ratio of starch and water by proportional valve means in accordance with a desired strength characteristic of the web as measured at the dry end of a paper machine and while maintaining a flow from the die at a relatively constant rate of flow into the fallen curtain of material.

15 Claims, 4 Drawing Sheets

PROFILING WET END STARCH APPLICATOR

RELATED APPLICATION

This application is a continuation-in-part of U.S. patent application Ser. No. 08/597,828 filed Feb. 7, 1996 entitled "Wet End Starch Application" now U.S. Pat. No. 5,792,317.

BACKGROUND OF THE INVENTION

This application relates to methods and apparatus by which flowable materials, such as particulate materials, are applied to a newly-formed web of paper at the wet end of a paper former. Starch is one such material, and is added to paper fibers to improve strength.

The strength of paper is measured by the well-known parameters of internal bond, tensile, fold, and burst. Such strengths are usually greatest at the machine center and decrease toward the edges of the web. This strength profile is sometimes called a "frown" as it is characterized by an inverted curve as measured in a cross machine profile. It requires that the strength targets be increased in order that all of the paper will meet the minimum strength requirements for the particular paper grade and for its intended use. The decrease or edge fall-off in strength, typically, may be in the order of ten percent, measuring from the center to each of the transverse edges of the web. Therefore, it is frequently necessary to employ an excess strength target in the order of about five to six percent to compensate for the fall-off.

Having to use an excess strength target results in a higher cost to the industry, and practical solutions to this problem are traditionally lacking. Strength may be increased by adding starch to the furnish, but a uniform application of starch does not compensate for the lack of flatness of the strength profile. A need therefore exists for an apparatus and process by means of which the amount of strength adding material, such as starch, may be varied across the width of the web, so that the profile, if desired, may be flattened or so that particular cross machine regions may be enhanced as compared to other regions.

SUMMARY OF THE INVENTION

In the above-identified co-pending parent application, uncooked starch particles or other material, are added at relatively high dosage rates to a web at the wet end of the paper machine. The apparatus achieves an even or uniform cross machine direction application at a high retention level. The application rate can be varied over time, so that changes in the strength characteristic of the sheet being produced, such as caused by changes in the fiber supply or the like, may be corrected. The apparatus and process of the co-pending application provide a system and method by which a starch suspension or other additives may be applied and, in the case of starch, the process and apparatus may be used in place of a conventional sizing press.

The suspension is applied through a die slot onto the exposed surface of a newly formed web, preferably at low table consistencies, as low as about two percent or less solids content of the paper fiber on the fourdrinier table or wire. Preferably, entrained bubbles that could cause skips in the coating are removed prior to the application of the suspension to the die.

Uncooked starch is, itself, somewhat hygroscopic and absorbs its weight in water, but does not appreciably expand until heated to a particular temperature called the cooking temperature. Since the particles are fully wetted on all surfaces, they are readily hydrated and activated with the remaining water in the sheet, by the heat which is applied in the dryer section of the paper machine. Excellent strength characteristics have been achieved, as well as excellent penetration of the starch particles through the thickness of the sheet, with very little loss of starch in white water.

The suspension is preferably heated prior to the application to the extrusion die, but only to a temperature below the temperature of rapid article swelling, i.e. the cooking temperature. The heated water content aids in the drainage of the water from the suspension of the stock on the wire after application to the newly-formed web. The heat in the suspension acts to heat the water content of the web over the suction boxes, thereby decreasing the viscosity of the fluid content and increasing the rate of water removal through the suction boxes.

The above-identified co-pending application also discloses that the cleanliness of the die lips may be improved by chilling the die lips immediately at the die exit orifice to a temperature such as to cause water vapor to condense from the air on the die lips. This condensation provides a wetted surface that resists the attachment of starch thereto and flushes the die lip surfaces so that they remain clean and unobstructed.

In the construction of the die, preferably one of the die lips, such as the upstream die lip, is downwardly offset from the other die lip to form a final curtain-forming land. The suspension flows through the die slot and past the end of the shorter die lip, along the planar surface of the longer die lip and the parts from a lower abrupt edge of the longer die lip and then falls as a curtain, to the surface of the web. Such a die lip extension provides stability to the curtain. By carrying the film beyond one of the die lips, along such a planar surface, eddy currents, which form at the terminus of the die lip, are isolated with respect to the shorter die lip, and the film is provided a short space in which to stabilize along the land of the longer die lip. Such a transition from two confining surfaces to one surface permits the surface tension to flatten and stabilize the flow at the region of extension, and further reduces friction to the flow, by eliminating one surface. Such features provide a highly effective die construction for applying a suspensionof uncooked starch particles to a wet web on a fourdrinier wire or the like.

In order to provide profile control, a closed or pressure type curtain former or die may be constructed with plurality of individual cross machine spaced inlets leading into an internal die manifold for flow into the extrusion slot. The plurality of cross-machine inlets effectively divides the die into a corresponding plurality of application zones, which are united in the die slot, which zones can be supplied with material having a controlled concentration of starch particles. In the parent application, starch is applied by the die at consistencies between about two to ten percent solids-liquid content in the die and good results were obtained in applications of uncooked particulate starch throughout this range. Since the process and apparatus are effective throughout the wide range of starch concentrations, it is now recognized that process permits the starch concentration to be varied throughout this range within the die according to a cross machine position and the amount of starch that it is desired to apply to the web.

For the purpose of controlling the starch concentration, or concentration of additives, at a plurality of transverse inlet locations or positions, the apparatus uses a pair of headers. One header contains a relatively high concentration of starch and water, such as ten percent by weight of solids content or more, and the other header contains water. A particulate starch suspension of about 10% will have the viscosity of water.

Flows of materials from the headers are fed to each of the die inlets through a pair of control valves, and then through a mixer, such as a static or motionless mixer. The control valves, which control the flow from the starch header and the water header into a die inlet through a mixer may be controlled by downstream cross machine direction measuring equipment, as known in the art, to effect desired changes in the starch concentrations applied to one or more of the die inlets, to achieve a desired downstream condition, usually a measured strength condition. Commonly, such a strength measuring device is located at the dry end of the paper machine.

Optimum operation of the die requires that the volume or mass flow rate of the slurry that is discharged through the die slot be relatively constant across the width of the die, to ensure that the slurry curtain falls on the wet web of paper or board at a relatively constant velocity and a relatively constant viscosity across the machine width. This is achieved by varying the concentration of the starch slurry while maintaining a constant volumetric flow, so that there is no significant flow differentiation across the width of the die between die control zones. The system of this invention accomplishes these objectives. It permits the strength profile to be flattened, and permits the optimization of the strength of the entire sheet to a specification. This, in turn, allows the use of raw materials to be minimized, or permits a lower grade of furnish (pulp) to be used in the formation of the sheet.

The substantially constant volumetric flow to each of the die zones is preferably accomplished by the use of the two headers, as previously mentioned, with cooperating pairs of valves corresponding to each cross machine direction such that the total flow through each pair of valves remains relatively constant, and substantially equal to the total flow of the adjacent pair of valves. Thus, one valve, which controls the starch concentration and the other valve, which controls the addition of water, is opened or closed under a common control to the end that the total flow remains relatively constant for a given condition. Preferably, the valves are designed such as to provide a linear response to opening or closing control signals. The pairs of valves may then be controlled in unison with other similar pairs of valves corresponding to other cross machine control positions to increase or decrease the overall flow rate through the downwardly opening die slot.

Preferably, each header is supplied with a liquid in which air bubbles have been removed, and preferably, the respective supplies are heated to a temperature above ambient, but less than the cooking temperature for the particular starch particles. A suspension of particulate matter, such as particles of uncooked starch, is unstable, in that the suspension will settle out or separate if not agitated or maintained in a fluidized condition. In order to prevent settling of the unstable suspension, the headers may be of a through-flow design, and the supply pump may be of a positive displacement type, so that there is maintained a constant through-flow of at least the starch suspension with recirculation of the excess material back to a supply tank at a sufficient rate to maintain the suspension.

A multiple inlet extrusion die is disclosed by which the transverse with a web is divided into a plurality of zones and in which the die is provided with a plurality of inlets leading to a common manifold and common die slot. The die accordingly may be fed or supplied with a suspension in which the starch or solids component, at any such zone, has been tailored, or automatically controlled, to maintain a particular downstream dry-end condition. In this manner, the die will be divided into a sufficient number of zones, usually a plurality of three or more, each zone representing an approximate cross machine proportion of the total width of the web, which zones may or may not be identical in width. While the inlets which feed such zones are separate to permit separate control of the quantity of suspended solids, nevertheless, the inlets open to a common manifold or other cross machine distribution chamber, and to a common die slot leading from the manifold to minimize the abruptness of change between adjacent zones. There is intended to be some mixing at the interface region between adjacent zones, but there is a minimum of mass flow across the zones in view of the fact that the control valves are preferably operated whereby a uniform overall flow rate is maintained by maintaining and stabilizing the flow rate at each zone.

The sizes of the inlets and the die slot are chosen in relation to the quantity of flow so that a scouring flow is maintained to prevent a stagnant condition thereby preventing settling by the unstable suspension. While this flow need not be technically a turbulent flow as such, nevertheless a turbulent flow condition is considered a scouring type of flow that resists and impedes settling out of the suspension prior to application to the die slot and the web.

The size and shape of the cross machine distribution chamber or manifold is important to avoid stagnant conditions, settling, and resultant starch deposits. Midway between each inlet there is a node that has essentially no cross machine flow. It is not an option to maintain scouring flow at the nodes as the die cavity would have to be reduced essentially to zero and reducing the cavity to zero would prevent mixing at the interface. These problems are solved by using a constant cross section die cavity with a sloped bottom. Slopes greater than 10% do not allow starch to build up. Other materials with faster settling rates would require a steeper bottom slope.

The invention may be described as a system for applying liquids or liquid materials from two sources, one of which may be a suspension of uncooked starch in water, to a moving fiber web on a forming wire. Such a starch applying system includes a source of an uncooked starch suspension in water and a source of dilution water. The die has a body positioned transversely of the forming wire and above the wire with an internal manifold or chamber extending substantially the length of the body and with a generally downwardly opening die slot, so that material may flow from the manifold through the slot and forms a falling curtain onto the web. The die slot has a substantially uniform gap width across its length.

The die body has a plurality of transversely spaced inlet passageways that lead into the manifold, thereby defining a corresponding plurality of material application zones across the web. A means is provided for applying material from the two sources to the inlet passageways at a substantially uniform total rate, so as to provide a flow rate from the manifold through the die slot that is substantially uniform along the length of the die slot. At least one of the inlet passageways, and preferably all of the passageways, are provided with means such as proportioning valves by which the ratio of material from the two sources may be varied for the purpose of varying the quantity of the applied starch to the web at transverse regions corresponding to the related zones.

In another aspect of the invention, one or more of the outermost zones may be used as a deckle to control the width of flow of one of the sources, such as the starch suspension, in the die slot. To accomplish this, water may be added at the most transverse or outer zones of the die and applied exclusively through the outermost inlets, to the die slot under a condition of controlled pressure. It is assumed that the die slot has a width which exceeds that of the trim width of the web to be formed. The water film going through the die slot, at the ends, forms a water deckle and conserves the amount of starch that must be applied to the die. By independently varying the quantity of water, the region of transition, defining the interface between the water and the starch suspension, may be varied as desired, over a range, and will save starch by reducing the amount of starch lost from the table. This interface between the starch suspension and water flows can be varied by varying the flow rate of the water so that increasing the flow rate causes the deckle line to move toward the die center, and decreasing the flow rate permits the deckle line to widen in the die slot. The operator can then control such flow with a valve or the like, in accordance with the positions which are set for the conventional downstream web trimmers, usually water jet cutters.

The invention may also be described as a method for applying a variable consistency suspension of uncooked starch in water, to a moving web of paper fibers on a forming wire at the wet end of a paper machine. A source of uncooked starch suspended in water is provided on the one hand. Preferably, it has been subject to deaeration. A source of dilution water is provided on the other hand, also preferably in deaerated form. These sources are applied to proportioning valve means to form an output that represents a ratio of materials from these sources. This output is applied to a closed curtain type coater die having a downwardly opening die slot extending above and transversely across the web to form a falling curtain onto the exposed upper surface of the web. The ratio of materials is controlled by the proportioning valve means in accordance with an on-line measured strength characteristic of the web as measured at the dry end of the machine, while maintaining the flow rate of the output from the slot at a relatively constant value into the curtain. The effective width of starch application through the die slot may be varied and controlled by the applications of water only at zones at the extreme ends of the die thereby forming adjustable water deckles.

In a preferred form of the method, a plurality of transversely spaced inlets lead to a common die slot, and proportioning valves are provided to control the application from the two sources identified above to these inlets. Measurement is made of the profile of strength of the web at the dry end of the machine, and the valves are operated so as to control the amount of uncooked starch applied by the die at each of the zones, while maintaining a relatively constant flow rate from the slot into the falling curtain. If the die end zones are used as water deckles, the width of starch extrusions through the slot may be accurately controlled by controlling the rate of water flow into such end zones.

It is, accordingly, an important object of the invention to provide method and apparatus for applying uncooked starch or other particles or materials directly to the web at the wet end of a paper machine and simultaneously to profile the flow of such materials onto the web, through a die, in the cross machine direction.

It is also an objective of the invention to control both the machine direction and cross machine concentration of a starch particle slurry, such as by using an on-strength measuring device to scan the sheet at the dry end of the paper machine and through a suitable controller, make the necessary upstream corrections.

Another object of the invention is the provision of apparatus and method by which a cross machine strength profile may be controlled, by controlling the relative solids concentrations of flow onto a newly formed web by an extrusion type die by varying concentrations of a suspension of particles in water at each of a plurality of die inlets.

A more particular object of the invention is the provision of a method and system, as outlined above, in which a suspension of uncooked starch in water is blended with dilution water in accordance with discreet transverse or cross machine locations on a web forming machine, to control a web characteristic or the profile of such web characteristic, such as strength.

A more particular object of the invention is the provision of apparatus by which profile characteristics of a dried paper product may be controlled at the wet end of the paper forming process by the application thereto of a starch suspension, and by controlling the concentration or consistency of the suspension in the cross machine direction as applied to the web.

Other objects and advantage of the invention will be apparent from the following description, the accompanying drawings and the appended claims.

DESCRIPTION OF PREFERRED EMBODIMENTS

Figure 1:
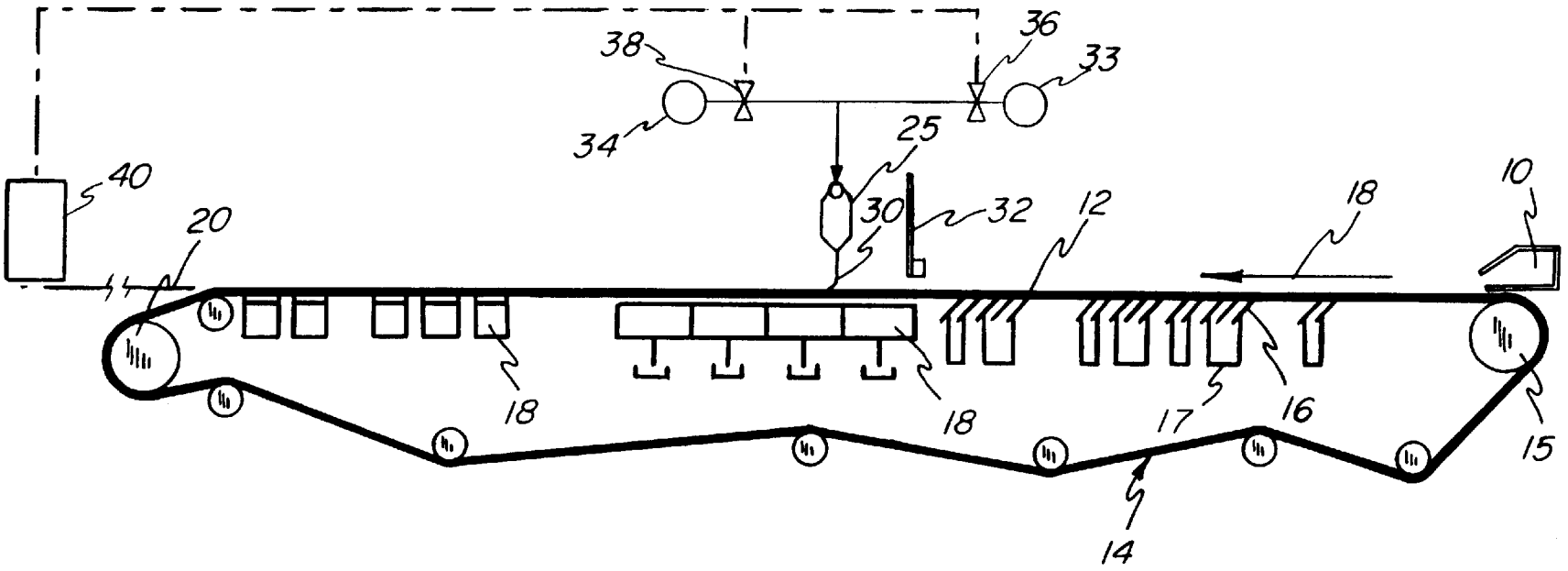
FIG. 1 is a diagrammatic side elevation of the forming wire portion of the fourdrinier machine showing a closed curtain coater die in approximate relation to the exposed surface of a forming wire, and illustrating further the relation of a dry-end scanner and control for the die valves.

Referring to FIG. 1, the table portion of a fourdrinier machine to which the invention may be applied is diagrammatically illustrated, in which a head box 1I conventionally applies a dilute slurry of paper making pulp or stock to the exposed upper surface 12 of an endless fourdrinier wire 14 at a breast roll 15. The pulp suspension is drained through the wire 14, aided by one or more of a plurality of deflection foils 16 leading into boxes 17, and one or more suction boxes 18, all of which are positioned under the table and having open tops over which the wire 14 runs. In a typical case, the stock slurry or suspension is applied by the head box 10 onto the surface of the wire 14, moving in the direction of the arrow 18 with an initial consistency of less than 1%, solids to liquid. Immediately upon being applied to the fourdrinier wire, the fibers of the paper stock suspension form or begin to form a web on the exposed upper surface of the wire 14 as the white water is drained form the fibers and through the wire by the foils as augmented by suction boxes.

The fourdrinier table is known as the "wet end" of a paper making machine, and while the pulp suspension from the head box 10 may hit the wire at the breast roll 15 at a consistency less than about 1%, by the time the web reaches the couch roll 20, the table consistency may be as high as 25%. It is therefore understood that a major portion of the original water content of the stock suspension is removed in the fourdrinier machine along the length of the wire 14.

FIG. 1 also diagrammatically illustrates a curtain coater type die body or applicator 25 which, is understood, extends the width of the wire 14, or even somewhat beyond, and transverse to the directions of movement of the wire. The die applicator 25 forms a falling curtain 30 of a liquid suspension of material which is added to or applied to the exposed upper surface of the fibers formed on the wire 14. A wind curtain 32 is shown as positioned adjacent the curtain coater die body 25 and preferably immediately upstream of the curtain 30 to assist in deflecting the movement of air which may be entrained by the rapidly moving wire 14, which air movement would tend to disrupt the curtain 30.

In the practice of this invention, a die 25 is employed which has a plurality of cross machine or transversely spaced inlets leading into a common internal chamber or manifold, as described with greater particularity with respect to FIGS. 2–5. The die inlets are provided with a suspension of uncooked starch particles in water under pressure for flow into the die and into a downwardly opening die slot for application as a curtain 30 to the top of the wire 14 and to a forming web on the surface of the wire. Preferably, the die 25 is located along the length of the wire so as to impinge the web at a region in which the table consistency (i.e., the consistency of the fibrous mat on the wire) is as low as about 2% or lower or up to about 10% or higher. Unexpected and unobvious results have been found where the material is applied at low table consistencies, such as about 2%.

In order to accurately control the consistency and rate of flow of the suspension applied to the die 30, it is preferred to use a pair of headers, one each connected to each of two sources of material. In the preferred embodiment one header 33 is connected to water under pressure and another header 34 is connected to deliver a relatively concentrated suspension of uncooked starch in water, under pressure, as shown in greater detail in FIG. 2. Flows from the headers 32 and 34 are through flow control valves 36 and 38, respectively to a die inlet, which valves may be automatically controlled by a dry end strength scanner 40.

Suitable scanning apparatus by means of which paper, at the dry end of the paper machine, may accurately be measured for strength characteristics and by which profiles of the strength characteristic in the cross machine direction may be measured, are known in the art. Reference may be had to one or more of the following U.S. Patents which illustrate systems and processes for continuous determination and, through a feedback loop, and in which parameters are controlled strength at the paper machine for varying the strength of the formed paper web and for scanning the strength characteristics in the cross machine direction. These patents include U.S. Pat. Nos. 5,104,488, issued Apr. 14, 1992, 4,991,432, issued Feb. 12, 1991 and 4,970,895, issued Nov. 20, 1990. A suitable measuring device for the purpose of making on-line strength measurements is shown in the previously mentioned patents and in U.S. Pat. No. 4,936, 141, issued Jun. 26, 1990.

Figure 2:
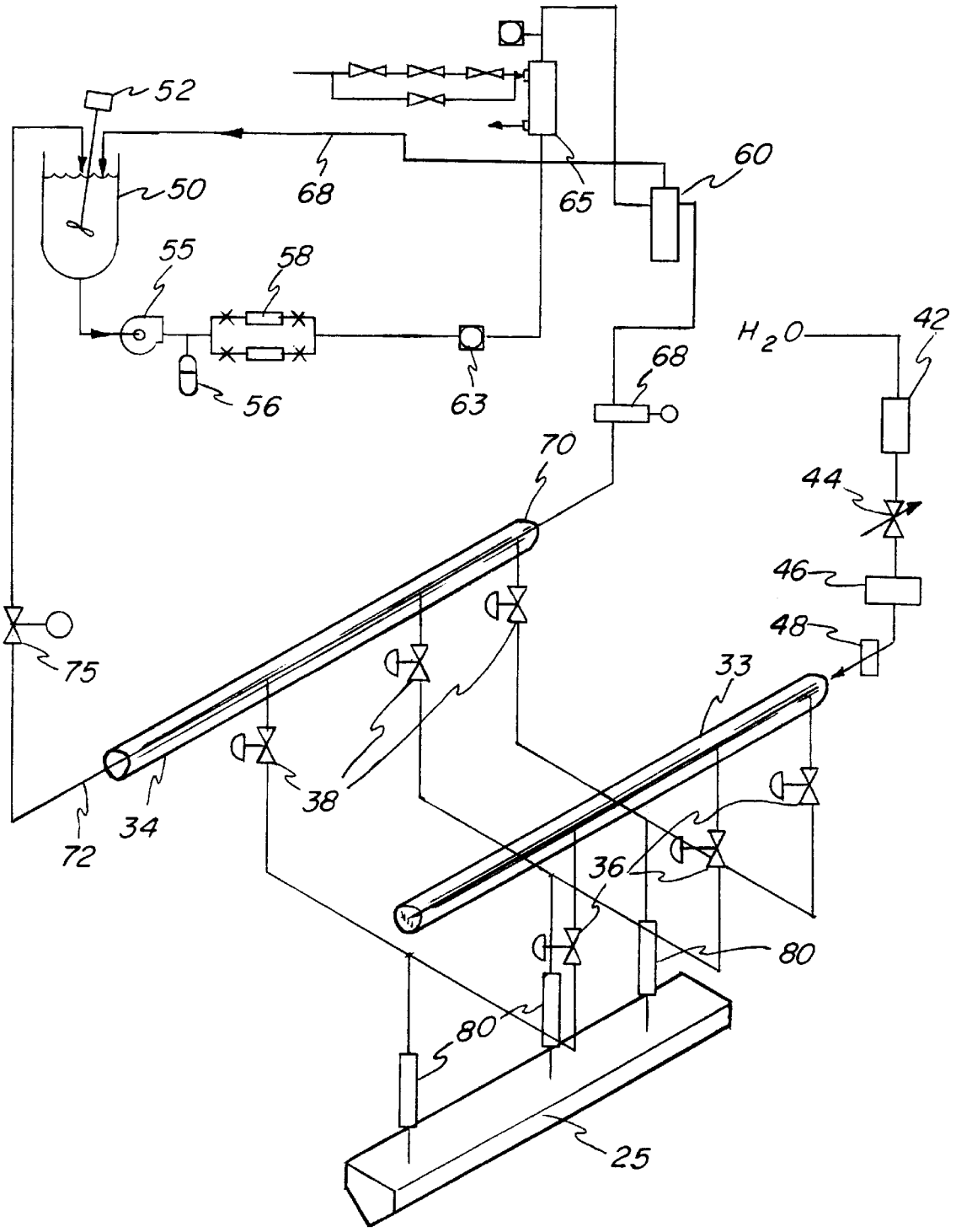
FIG. 2 is a schematic diagram illustrating the principal components of the invention with a flow diagram showing the application of a liquid to the headers that supply feed the die.

FIG. 2 diagrammatically illustrates the die 25 and the feed headers 33 and 34. The die 25 has multiple inlets spaced transversely of the direction of web travel, that is in the cross machine direction. The header 33 contains filtered and heated water under a regulated pressure, as heated by a heater 42 with a pressure controlled by a pressure regulator 44. Preferably, a deaerator is used to remove any air entrained with the water supply, so that the water within the header 33 is essentially free of air bubbles that could cause gaps or skips in the application of the material by the die 25. For this purpose, a deaerator 46 may be used, and a water filter 48. The deaerator may be of the kind disclosed in the U.S. Pat. No. of Taylor et al. 5,149,341, issued Sep. 22, 1992.

Header 34 is supplied with a relatively rich suspension of an uncooked starch in water, under pressure. The tank 50 forms a source of such suspension, which may be maintained in a fluidized condition by the agitator 52. Suitable make up lines and level control means for the tank 50 may be included, not shown.

A variable speed constant displacement pump 55 delivers the suspension at a controlled rate and pressure, and a pulsation chamber 56 may be placed in the line for reducing pulses. Preferably one or more filters 58 are in line to remove larger starch agglomerations and lumps that would interfere with the degassing of the suspension.

The deaerated suspension is applied through an optional flow meter 63 to a heater 65. The heater 65 may be electric but is preferably a jacketed hot water type heater. It is preferred that the suspension in header 34 as well as the water in header 33 be maintained at an elevated temperature but in all instances less than the cooking temperature of the starch.

Preferably, the starch suspension is degassed after heating to remove entrained air in the form of foam and bubbles and any gasses that are released by reason of the heating. Generally, it is desirable that no bubble be allowed to remain in the suspension, to be applied to the die 25, that has a diameter which exceeds the extrusion slot width of the die. A particularly effective deaeration apparatus 60 is that shown in the previously described Taylor et al U.S. Pat. No. 5,149,341. An air-rich fraction is returned on line 61 to the tank 50.

A filter, such as a vibrating filter, 68 forms a final filter to prevent any particles entering which could plug the die slot. A vibrating filter is preferred, such as model SS-0736-VIB of Ronnigen-Petter, 9151 Saver Road, Portage, Mich. 59081.

The header 34 is preferably of a through flow design with an inlet at end 70 and a smaller outlet at end 72 by which a through flow condition may be maintained to prevent settling of the suspension. The rate of flow and the pressure within the header may be maintained by a controllable valve 75, returning the through flow material to the tank 50.

Stock suspension from the header 34 and dilution water from the header 33 are applied to individual die inlets through the previously mentioned controllable valves 38 and 36 as mentioned in connection with FIG. 1. Individual linear control valves, which may be controlled by air or by an electric signal, are preferred, with one of the valves 36, 38 being a normally open valve which controls to the closed position, while the other valve is a normally closed valve, which controls to the open position. The scanner 40 controls the valves on the starch and water headers via either a programmable logic controller or a distributed control system. While two individual one-way valves are shown and are preferred, it is within the scope of the invention to use a three-way spool valve having two inlets and a common outlet, which is proportional in operation so that movement of the spool decreases the flow from one inlet while at the same time increases the flow from the other inlet.

The outlets of the valves 36, 38 are applied to an in-line static mixer 80 and then applied to a discreet one of the plurality of die inlets. The in-line static mixer may be of the kind supplied by Kenics Corp. North Andover, Mass.

The header pressures may be relatively low, such as about ten psi. Solids content, however, in the header 34 is relatively high, such as in the range of about 8% to 15%, although suspensions substantially above 10% are difficult to handle. The controllable valves 36, 38 may be respectively ATO one-half inch type 807/766-316 and ATC, one-half inch, type 807/759-316 (air-controlled) of Badger Meter Incorporated, 6116 East 15th Street, Tulsa, Okla. 74112. The two headers are maintained at substantially equal and constant pressures. Each pair of valves 36, 38 is arranged to give uniform total flow to the die with variable ratios of water and starch slurry and these flows into the inlets are all substantially equal to each other. Valves are controlled by the scanner 40 as a pair, working back to back, to provide a constant flow to the particular die inlet.

Since each inlet receives substantially the same rate of flow, there is very little disturbance formed in the die between the inlets during control procedures. Each pair of the valves is controlled so as to provide the correct application rate of uncooked starch to the web, at the particular die zone defined by the inlet, corresponding approximately to the spacing between inlets.

In a typical paper machine installation, the spacing between die inlets would normally be uniform. This spacing would typically be between about five inches to 25 inches.

Figure 4:
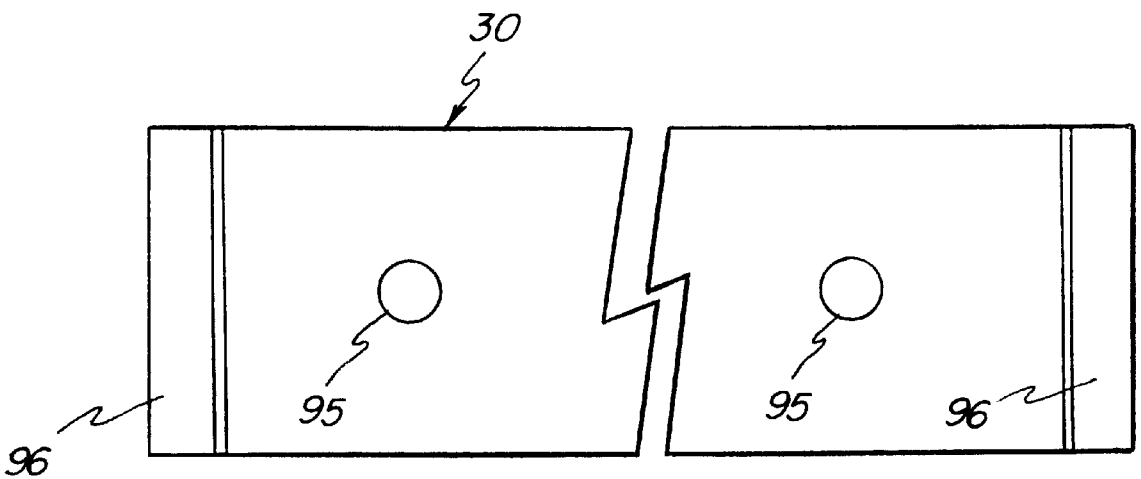
FIG. 4 is a partially broken away side view of the die of FIG. 3.
Figure 3:
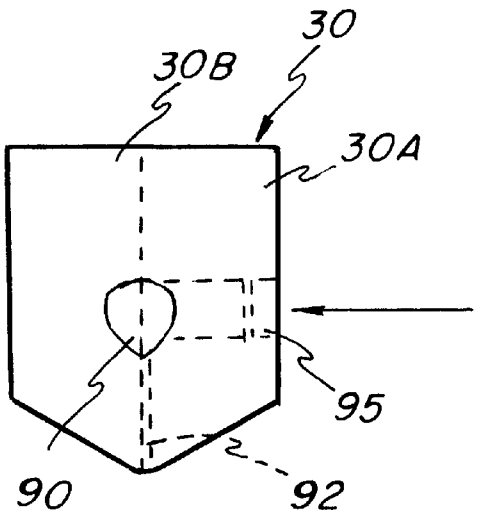
FIG. 3 is an end view of one form of a die that may be used with this invention.

One preferred form of the die 25 is illustrated in FIGS. 3 and 4. The die 25 could conventionally be formed in two parts, such as the part 30*a* and the mating part 30*b*, jointly defining an internal manifold or passageway 90. In the illustration of FIG. 3, the manifold 90 has a tear drop shape and leads to the downwardly opening die slot 92, shown in greater detail in FIG. 6. One of the two die parts, such as the part 30*a*, is provided with a plurality of transversely entering feed inlets 95, which open into the manifold 90. It is preferred that the manifold 90 be of substantially constant cross-sectional area across the width of the paper machine and have a side well shape that does not allow suspended starch or other particles to settle out and block the die slot 92 or block the manifold 90. The actual dimension therefore of the manifold 90 may be maintained fairly small, as compared to a plastic extrusion die, for example.

The manifold 90 and the slot 92 have a width corresponding generally to the width of the web being formed or slightly greater than the web width. In the latter case, suitable catch basins may be positioned at the lateral edges of the web to catch material extruded downwardly as a falling curtain beyond the width of the web, for recirculation to the tank 50, as disclosed in the parent application. As previously described, the lateral ends of the manifold 90 may extend beyond the web and be fed by water to form a water deckle.

A plurality of inlet ports are used, i.e., at least three or more, and the number of transversely spaced inlet ports 95 that are employed depends upon the degree of control that is desired over the application of material, at lateral positions, onto a formed web carried by the wire. Generally, the inlets should be spaced apart by equal spacing increments and should be spaced from the closing end plates 96 of the die 25 by a distance that is approximately half the distance between adjacent inlets.

Figure 5:
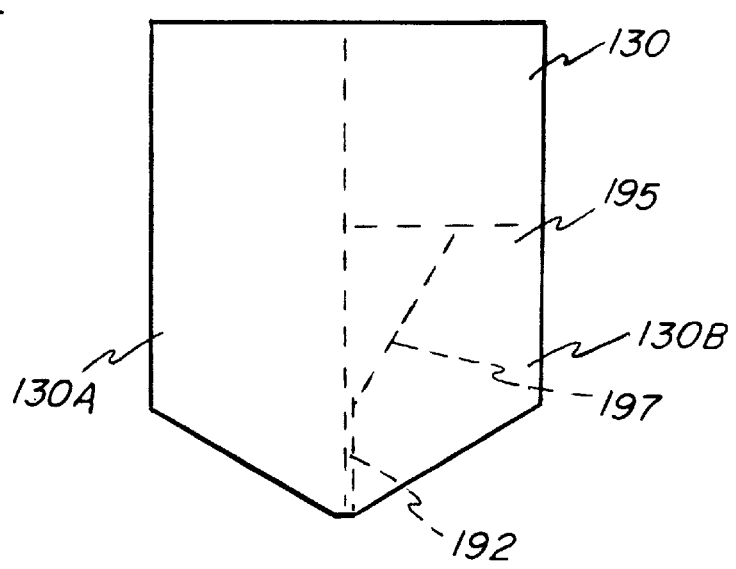
FIG. 5 is an end view of a modified form of a die that may be used to practice this invention.

An alternative preferred form of the die is illustrated at 130 in FIG. 5, including body parts 130*a* and 130*b* and inlets 195 corresponding to the inlet 95. However, in this case, the internal manifold or cavity 190 is formed entirely in one of the die parts, such as the part 130*b* leading to the die slot 192. The cavity 190 is shown as having a triangular shape, when closed by the mating wall of the die body 130*a*. A sloping wall 197 in the body 130*b*, sloping at an angle toward the die slot 192 defines the die cavity 190. The inlets 195 open into the cavity 190. Flow through an inlet 195 impinges against the mating wall of the die body 130*a*, thereby creating a change in flow direction that creates turbulence in the flow and helps to prevent settling of the suspension. Further, the embodiment shown in FIG. 5 has the advantage of lower costs, since only the circular openings, i.e., the inlets 195 and flat planer walls are provided in one of the die body parts, thereby simplifying machining and manufacturing steps, as compared to a die in which the die cavity is formed equally in each of the two body parts, as in the embodiment of FIG. 3.

As previously noted, it is important that the manifold or passageway 90, FIG. 3 or 190, FIG. 5 have surfaces which slope more than 10° to prevent starch buildup or settling of particulate matter. Materials having a faster settling rate than starch would require a steeper slope to prevent settling. The tear drop configuration of the passageway 90 in the embodiment of FIGS. 3 and 4, and the sloping wall 197 in the embodiment of FIG. 5 form angles greater than 10° to the horizontal and thus effectively prevent build up or settling of starch particles on their respective surfaces.

Figure 6:
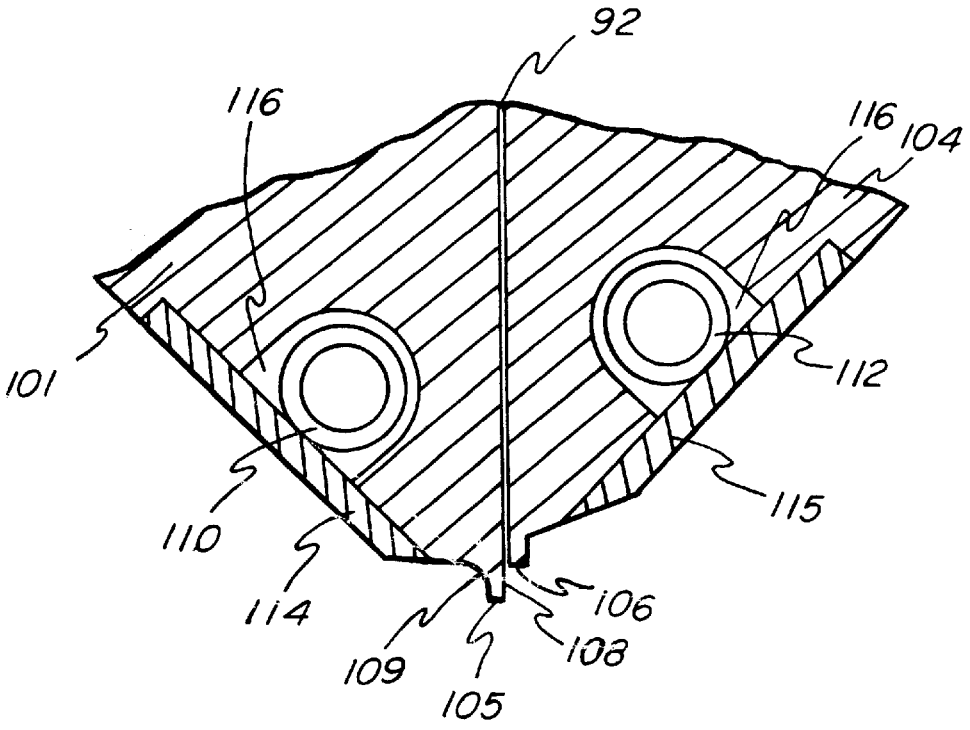
FIG. 6 is a partially broken away bottom view of the die of FIG. 3 or FIG. 5 showing the feedslot and the die lips, and illustrating the cooling passageways extending longitudinally of the die lips.

FIG. 6 is an enlarged fragmentary cross-sectional view of the lower portion of the die showing the die lips and die slot, and applies to either of the embodiments of FIGS. 3 or 5. The reference numerals used to designate the parts of the die are those chosen for FIG. 3, although the concepts shown in FIG. 6 may be applied to the die 130 of FIG. 5.

A preferable die lip arrangement is shown in FIG. 6 in which the die slot 92 terminates at the pair of opposed die lips 102 and 104. Each die lip is provided with a downwardly depending cut-off portion which provides flat ends 105 and 106, each forming the lower terminus of the respective die lip. It will also be seen that the lower end 105 of the die lip 102 is preferably extended below the end 106 of the die lip 104 so that material flowing through the slot 92 will then flow along an exposed land surface portion 108 associated with the die lip extension 109. The land portion 108 that is exposed below the bottom terminus 106 of the die lip 104 provides a flow control surface on which the curtain flows downwardly and accelerates toward the fourdrinier wire, and a region in which a surface of the falling curtain is exposed to surface tension. By offsetting the lower terminus of the die lips one with respect to the other, a short region is formed in which the curtain is constrained only by one surface, thus substantially reducing friction as compared to the condition where the flow is between parallel walls.

The die may also include a means for keeping the die lips clean and free of accumulated materials. To this end, a pair of conduits 110 and 112 forming cooling flow passages may be made of a suitable heat conductive material and provide for the chilling of the die lips in accordance with refrigerated or cooled liquid flowing through the cooling passages. The conduits are associated with and joined to flat plates 114 and 115 along the outer surfaces of the die lips.

The arrangement permits the die lips to be cooled to a temperature below the dew point temperature, to cause condensation to form on the exterior surfaces of the die lips and the plates 114 and 115 , so that these surfaces are pre-wetted and are resistant to build up of coating materials. Preferably, an air space 116 is provided between the cooling conduits 110 and 112, to assure that the cooling is confined as much as practical to the plates 114 and 115 and to the outer surfaces of the lips, and does not unduly chill the surfaces which form the extrusion slot 92.

The flow rates as described in detail in the parent application, may be employed with the apparatus of this invention. In the parent application, the die slot is described as having a dimension of about 0.1 inches with flow rates varying from 0.1 to 0.25 gallons per minute per linear inch of die length or die slot. Additionally, the spacing of the die from the table or wire surface may be that as described in the parent application, as little as about one-half inch up to about 14 inches, with spacings in the range of four inches to eight inches being preferred. In the example given in the parent application, the exit velocity of the suspension from the slot was about 1.7 meters per second at a five inch height and the landing velocity of the curtain on the web was about 2.3 meters per second. It should be understood that these values, once chosen and defined, do not change substantially throughout the control range of the apparatus and system, since the flow rate is intended to remain relatively constant into each of the individual die inlets 95 and therefore through the die and onto the web.

The valve pairs 38 and 36 are controlled by downstream scanning and sensing means 40, as previously defined, typically by way of a Programmable Logic Controller or a Distributed Control System. Known control systems are disclosed in the patents previously identified. For the purpose of this invention, it can be assumed that strength will generally vary linearly or substantially so with the amount of starch added or deleted from a norm amount, which norm may be chosen at levels up to 100 pounds per square feet or more. The adjusted amounts are proportionally applied by the valve combinations 36, 38 to the motionless mixer 80, for thorough blending, and then to the particular die inlet 95.

While the form of apparatus and method herein described constitute preferred embodiments of this invention, it is to be understood that the invention is not limited to these precise forms of apparatus and method, and that changes may be made therein without departing from the scope of the invention as defined in the appended claims.

What is claimed:

1. The method of applying a variable consistency suspension of uncooked starch in water to a moving web of paper fibers on a forming wire at the wet end of a paper making machine, comprising the steps of: providing a source of uncooked starch suspended in water; providing a source of dilution water; applying said sources to a proportional flow control valve and forming a mixed output that represents a ratio of materials from said sources; applying said output to a closed curtain-forming die having a manifold opening into a generally downwardly-opening die slot extending above and transversely across said web to form a falling curtain of said output onto an exposed upper surface of the web; and controlling the ratio of said materials by said proportional flow control valve in accordance with a measured strength characteristic of said web as measured at the dry end of said machine while maintaining the flow of said output from said slot at a relatively constant rate into said curtain.

2. The method of claim 1 in which said die is formed with a plurality of transversely spaced inlets leading to the die manifold at transversely spaced locations thereby dividing said die into a corresponding plurality of coating zones, and in each said coating zone a proportional flow control valve is provided to control the application of materials from said sources to each of said inlets, further comprising the steps of the measuring of the profile of web strength at said machine dry end, and controlling said proportional flow control valves to vary the amount of uncooked starch applied by said die in each of said zones while maintaining said relatively constant flow rate from said slot into said curtain.

3. The method of claim 1 in which said curtain is applied to said web at a position in which said web has a consistency of between about 2% to 10%.

4. The method of claim 1 in which uncooked starch in said curtain represents by weight about 2% to 10% of the weight of the material in said curtain.

5. The method of applying a variable amount of a suspended particulate material on a moving web in accordance with particular cross-machine positions of said web using a coating type applicator die positioned above such web and having a plurality of transversely spaced die inlets leading to a die manifold and defining a plurality of application zones comprising the steps of: providing a first source of said suspended particulate material in a water base, providing a second source of dilution water, applying said sources to said die inlets, and with proportioning valves, controlling the flow from said sources to each of said inlets to apply the desired quantity of said particulate material in said zones while maintaining the mass flow rate through said die at each of said zones at a relatively constant value.

6. A system for applying a flowable coating composition made up of coating components from two sources onto a moving fiber web on a forming wire, said system comprising a die having a body positioned transversely of said wire and above said web, said die body having an internal manifold extending substantially the length of said die body and having a die slot through which said coating composition may flow from said manifold onto said web, said die body having a plurality of transversely spaced inlet passageways leading into said manifold thereby defining a corresponding plurality of coating composition application zones across said web, flow control valves applying said coating components from said sources to said inlet passageways at substantially uniform rates to provide a flow rate from said manifold through said die slot that is substantially uniform along the length of said die slot, wherein said flow control valves include at least one proportional flow control valve associated with at least one of said inlet passageways for varying the ratio of coating materials fed to said at least one passageway from said sources.

7. The system of claim 6 in which the coating component from one of said sources is a suspension of uncooked starch in the water and the coating component from the other source is water, and further including means for heating each of said components to a temperature less than the cooking temperature of said uncooked starch.

8. The system of claim 7 in which said die slot terminates in a pair of opposed die lips, each of said die lips having a fluid conduit extending along the length thereof for applying a cooling fluid thereto through which said die lips may be chilled.

9. The system of claim 6 in which said die slot terminates in a pair of opposed die lips, in which one of said lips has an extension in the direction of flow through said slot beyond the other of said lips so that said coating composition flowing though said slot follows said extension before leaving said die.

10. The system of claim 6 in which said internal manifold has a relatively constant cross sectional area along its length.

11. A system of claim 10 in which said die slot is formed with a relatively uniform width along its length.

12. The system of claim 6 in which said flowable coating composition is an unstable suspension of particulate materials, further comprising said manifold having wall surfaces which slope toward said die slot at an angle sufficient to prevent settling thereon by such particulate materials.

13. The system of claim 10 in which said manifold surfaces slope toward said die slot at an angle greater than 10°.

14. The system of claim 6 wherein a plurality of proportional flow control valves is provided, each said proportional flow control valve being associated with one of said inlet passageways, whereby the ratio of coating components fed to each said inlet passageway from said sources may be varied.

15. The system as recited in claim 6 wherein said flow control valves include a first and a second proportioning flow valve connected to each of said inlet passageways, said first proportioning valve connected to said first source and said second proportioning valve connected to said second source.

* * * * *